United States Patent [19]

Troutner

[11] Patent Number: 4,573,884

[45] Date of Patent: Mar. 4, 1986

[54] PERISTALTIC PUMP

[75] Inventor: Vernon H. Troutner, St. Petersburg, Fla.

[73] Assignee: Extracorporeal Medical Specialties, Inc., King of Prussia, Pa.

[21] Appl. No.: 636,040

[22] Filed: Jul. 30, 1984

Related U.S. Application Data

[62] Division of Ser. No. 410,736, Aug. 23, 1982, Pat. No. 4,487,558.

[51] Int. Cl.[4] ..... F04B 9/14; F04B 43/08

[52] U.S. Cl. ..... 417/374; 417/477; 74/547

[58] Field of Search ..... 417/477, 476, 475, 374; 74/547

[56] References Cited

U.S. PATENT DOCUMENTS 1,444,864 2/1923 Biederman ..... 74/547 R
3,700,361 10/1972 De Vries ..... 417/477

*Primary Examiner*—Richard E. Gluck
*Attorney, Agent, or Firm*—Lawrence D. Schuler

[57] ABSTRACT

Peristaltic pump including a housing having a backing plate and an upstanding arcuate wall, a pump shaft mounted in the backing plate, and a rotatable pump head mounted on the shaft and comprising at least one roller means for squeezing a segment of flexible tubing against the arcuate wall to achieve pumping of a liquid through the tubing. The pump head includes a pivotable handle having a recessed portion which cooperates with a ledge in the pump shaft to prevent the pump head from moving upwardly from the shaft when the pump is in operation. Also included are means comprising a roller bearing and clutch assembly for preventing rotation of the pump head in an incorrect or undesired direction during manual operation.

3 Claims, 7 Drawing Figures

Fig.3.
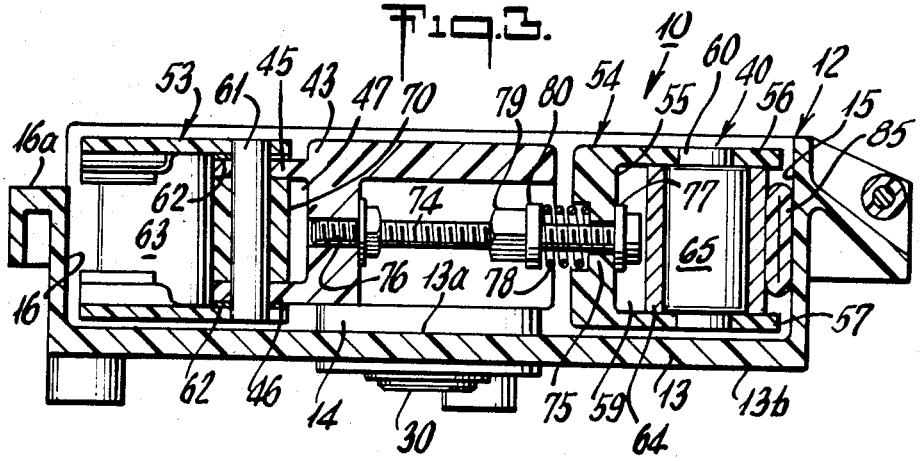
Fig.4.
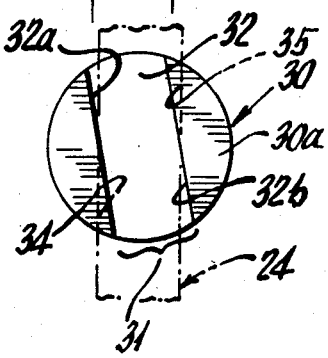
Fig.7.
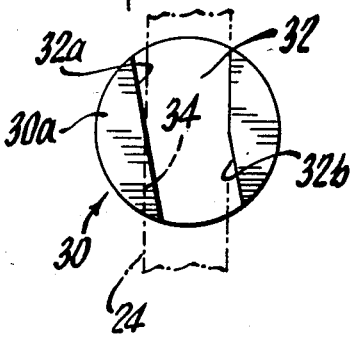
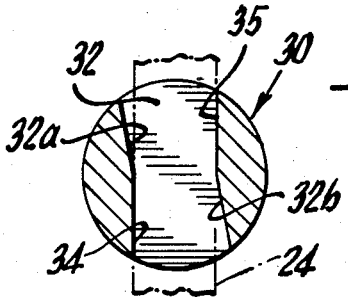
Fig.6.
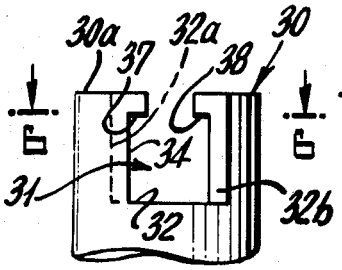
Fig.5.

PERISTALTIC PUMP

FIELD OF THE INVENTION

This is a division of application Ser. No. 410,736, filed Aug. 23, 1982, now U.S. Pat. No. 4,487,558.

This invention relates to improvements in peristaltic pumps. More particularly, the invention relates to an improved peristaltic pump which has means for preventing its pump head from rotating in an undesired direction during use. The invention also relates to an improved peristaltic pump which has means for preventing its pump head from moving upwardly on its pump shaft when the latter is driven by power source such as an electric motor.

BACKGROUND OF THE INVENTION

Peristaltic pumps in general comprise a housing having a backing plate and an upstanding arcuate wall against which a section of flexible tubing is placed. The pump comprises in addition a rotatable pump head which is removably mounted on a shaft connected to a suitable drive means, which can be, for example, a DC motor. The pump head includes at least one rotatable roller means which, as the pump head rotates, squeezes the aforementioned section of flexible tubing against the arcuate wall of the pump. The progressive squeezing of the section of flexible tubing between the rotating roller means and the arcuate backing wall displaces a liquid contained in the lumen of the section of flexible tubing. The fluid is displaced ahead of the roller means, that is, the displacement of fluid in the flexible tubing corresponds to the direction of rotation of the pump head. Preferably, the pump head comprises two roller means, one of which begins engaging the section of flexible tubing at about the time the other is ending its engagement therewith.

As indicated above, the pump head, which rotates during use, is removably mounted on a pump shaft which is connected to a suitable drive means. The pump shaft has an opening extending inwardly from its top end. The pump head has a centrally located opening and is mounted in the pump by placing it over the pump shaft. It is conventional for the upper surface of the pump head to carry a pivotally mounted handle comprising an arm and a gripping means. The pump head is mechanically coupled to the pump shaft by pivoting the handle means so that its arm engages the opening in the upper end of the shaft. With the pump head thus mechanically coupled to the shaft, rotation of the pump shaft imparts the desired rotary motion to the pump head.

Peristaltic pumps have found use in a variety of medical applications such as blood dialysis and blood oxygenation. In dialysis, for example, a peristaltic pump is used for continuously removing blood from a patient having kidney disease, conveying the removed blood through an extracorporeal circuit including a blood conduit and an artificial kidney where the blood is purified, and returning the purified blood to the patient. In the case of open heart surgery, a blood oxygenator is employed to take over the gas exchange function of the lungs. In this case, the peristaltic pump is used for removing blood from the patient undergoing surgery, conveying the removed blood through an extracorporeal circuit including a blood conduit and a blood oxygenator, and returning the removed blood to the patient after oxygenation.

A patient undergoing dialysis or blood oxygenation might by seriously endangered if the pump being used to convey the patient's blood were to stop functioning owing, for example, to a power failure. In such case, it is highly desirable to be able to manually operate the pump head so that the pumping of blood will not be interrupted. In addition, it is usually desirable to be able to manually operate the pump head when the section of flexible tubing used with the pump is being inserted into position between the arcuate backing wall and the roller or rollers comprising the pump head. Means are usually provided, therefore, for enabling an operator to manually rotate the pump head in the event of a power or other failure or while setting up the extracorporeal circuit prior to beginning a medical or surgical procedure. These means quite commonly include a handle pivotally attached to the upper surface of the pump head. In the event it becomes necessary or desirable to manually operate the pump, this handle means is brought into its operative position at an angle to the upper surface of the pump head and is used to manually rotate the pump head.

If it is necessary to resort to manual operation of a pump during the course of a medical or surgical procedure, care must be taken that the pump head is rotated in the proper direction. In other words, the pump head must be rotated so that blood coming from the patient's arterial system is directed to the inlet of the pump, then through the section of flexible tubing to the outlet of the pump, and finally from the outlet of the pump to the venous return of the patient. Inadvertent rotation of the pump head in a direction which pumps blood in the reverse sense, that is, in a direction from the blood outlet to the blood inlet of the pump, must be avoided.

In the circumstances surrounding a power or other pump failure, and where it is necessary to operate the pump manually, an additional responsibility rests on those operating the pump and its associated equipment to see that the flow of blood is maintained in the proper direction. It is highly beneficial then if the pump includes means which prevent rotation of the pump head in a direction which would convey blood toward the inlet of the pump rather than towards its outlet.

As mentioned earlier, it is known to mechanically couple the pump head with the pump shaft by providing a handle on the pump head which can be pivoted into engagement with an opening in the upper portion of the pump shaft. In order to insure proper operation of the pump, there should be no tendency of the pump head to move upwardly on, or to lift off, the pump shaft. Hence, it is highly desirable that the pump include means for preventing the pump head from moving upwardly on the pump shaft when the shaft and the mechanically coupled pump head are being driven by an external power source such as an electric motor.

SUMMARY OF THE INVENTION

In accordance with one aspect of the present invention, there is provided an improved peristaltic pump of the roller type which includes means for preventing rotation of the rotor assembly of the pump in an undesired direction during manual operation. The improved pump comprises a backing plate having an upper surface, a lower surface, and an opening therethrough, a bearing mounted in said opening, a shaft mounted in said bearing, said shaft having a first or upper end portion and a second or lower end portion, the first end portion extending upwardly from the upper surface of the backing plate and having an opening extending inwardly from the upper end of the shaft, the second end portion of the shaft extending downwardly from the lower surface of the backing plate and being adapted for coupling to a drive means, an upstanding, U-shaped backing wall on the upper surface of the backing plate, a pump head removably mounted for rotation on the upper portion of the shaft, said pump head comprising a hub portion with an opening therein and at least one roller means mounted for rotation about an axis which is parallel to the axis of the pump shaft, a handle means comprising an arm and a grip portion pivotally mounted on said pump head and adapted to be brought into engagement with the opening in the shaft to mechanically couple the pump head to the shaft, and means which allow said roller means to rotate in one circumferential direction but not the other. Preferably, the said roller means are mounted in a combination roller bearing and overriding clutch assembly which allows rotation of the roller means in one direction and prevents rotation thereof in the opposite direction.

In accordance with another aspect of the present invention, there is provided an improved peristaltic pump of the roller type which includes means preventing the pump head from lifting off, or tending to lift off, the pump shaft when the latter is being driven by a power source such as an electric motor. The improved pump comprises a backing plate having an upper surface, a lower surface, and an opening therethrough, a bearing mounted in said opening, a shaft mounted in said bearing, said shaft having a first or upper end portion and a second or lower end portion, the first end portion extending upwardly from the upper surface of the backing plate and having an opening extending inwardly from the upper end of the shaft, the second end portion of the shaft extending downwardly from the lower surface of the backing plate and being adapted for coupling to a drive means, an upstanding, U-shaped backing wall on the upper surface of the backing plate, a pump head removably mounted for rotation on the upper portion of the shaft, said pump head comprising a hub portion with an opening therein and at least one roller means mounted for rotation about an axis which is parallel to the axis of the pump shaft, a handle means comprising an arm and a grip portion pivotally mounted on said pump head adapted to be engaged with the slot in the shaft to mechanically couple the roller assembly to the shaft, the arm of said handle comprising a generally centrally located recessed portion and the shaft comprising at least one ledge whereby, when the pump shaft is rotated, said ledge overrides said recessed portion, thus preventing the pump head from moving upwardly on the shaft when the shaft is rotated. Preferably, the shaft of the pump comprises two diametrically opposed ledges for this purpose.

BRIEF DESCRIPTION OF THE DRAWINGS

The foregoing and other aspects of the present invention will be better understood by reference to the accompanying drawings in which:

FIG. 3 is a cross-section, with some parts shown in elevation, taken along line 3—3 of FIG. 1;

FIG. 4 is a top plan view of the pump shaft showing the arm, illustrated in phantom, of the pump handle in its "locked" position;

FIG. 5 is a view in elevation showing the details of construction of the upper portion of the pump shaft;

FIG. 6 is a cross-section taken along line 6—6 of FIG. 5 and showing, in phantom, the arm of the pump handle; and FIG. 7 is a top plan view similar to FIG. 6 and showing a modification of the pump shaft.

DESCRIPTION OF THE PREFERRED EMBODIMENT

Figure 1:
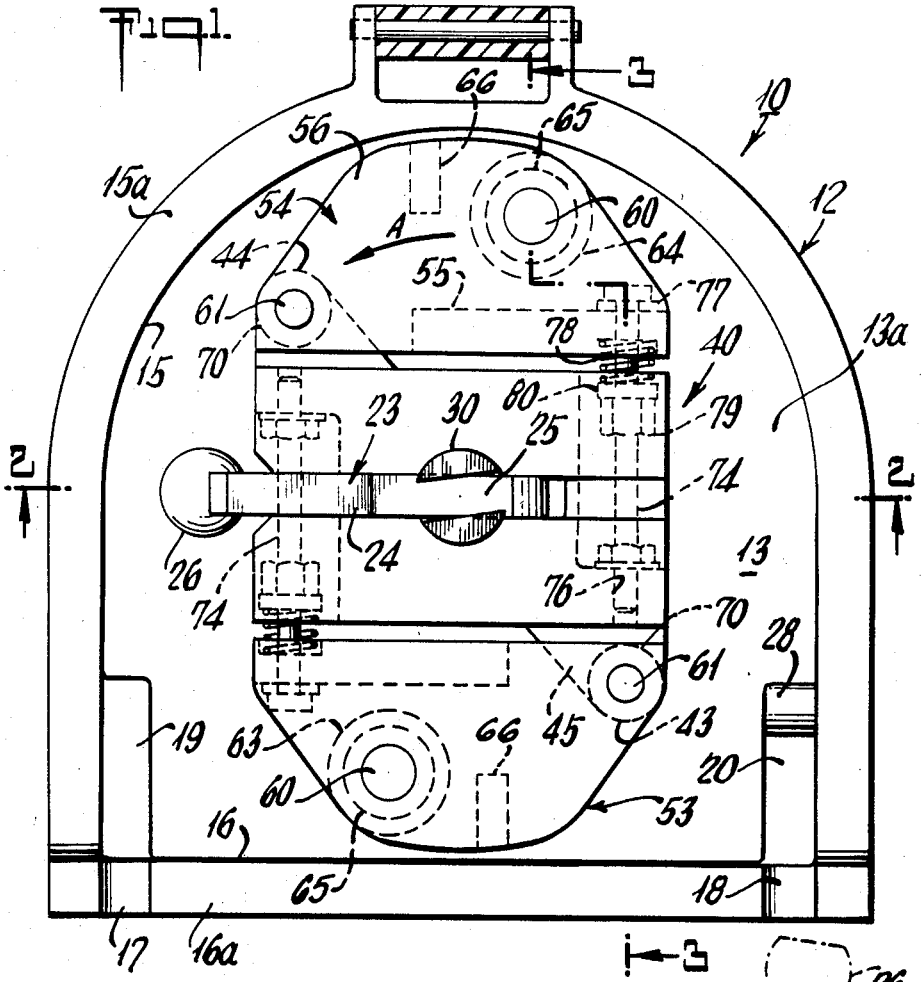
FIG. 1 is a top plan view, with certain parts in cross-section, of a roller pump in accordance with the present invention.
Figure 2:
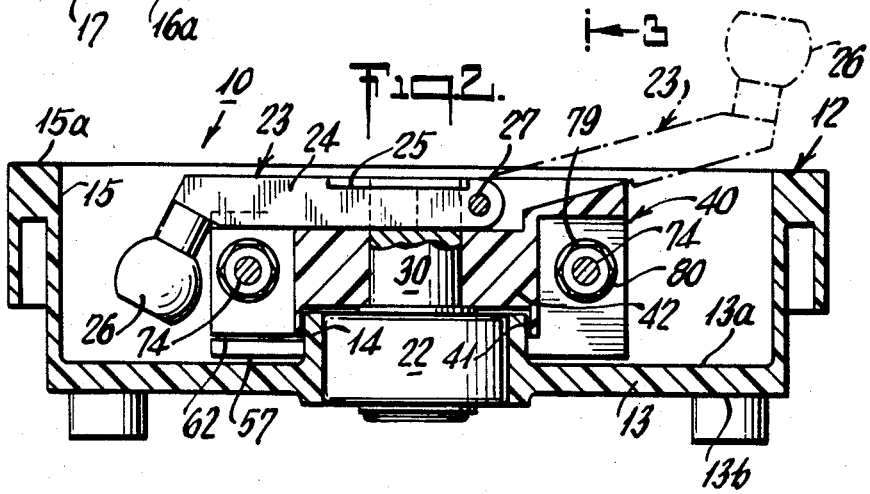
FIG. 2 is a cross-section, with some parts shown in phantom, taken along line 2—2 of FIG. 1.

Referring now to FIGS. 1–3 of the accompanying drawings, there is shown roller pump 10 comprising a casing 12, a shaft 30, and a rotatable pump head 40. Casing 12 comprises a lower base plate 13, an upstanding annular wall 14 which is located interiorly and generally centrally of base plate 13, and an upstanding, generally U-shaped backing wall 15 located outwardly of annular wall 14. Base plate 13 comprises an upper surface **13*a* and a lower surface 13*b*. As will be seen most readily in FIG. 2, wall 14 is considerably smaller in height than wall 15. The casing also has a front wall 16 which has opening 17 and 18 at either side thereof to receive the flexible tubing segment through which the liquid to be pumped passes during operation of the pump. The uppermost edge 16*a* of wall 16 is higher than the uppermost edge of wall 14 and lower than the uppermost edge 15*a* of wall 15. The lower edges of openings 17 and 18 in the front wall are contiguous with the upper surfaces of tubing support platforms 19 and 20, respectively, which are positioned perpendicularly to the front wall and extend backwardly a relatively short distance therefrom. The flexible tubing lies on support platforms 19 and 20 when the tubing is mounted in position in the pump casing. A tubing guide means 28, which may be, for example, a short length of round metal or plastic stock, is attached to the inside surface of wall 15 above support platform 20. This guide means is located a short distance rearwardly of the point of intersection of arcuate backing wall 15 with front wall 16. In operation, the flexible tubing segment is placed between support platform 20 and guide means 28**.

Annual wall 14 defines a circular opening which receives a bearing 22 in which pump shaft 30 is mounted for rotation. The pump shaft is suitably retained in bearing 22 by inserting two snap rings in grooves located on the pump shaft, one at a point just above the upper surface of bearing 22 and the other at a point just below the lower surface of bearing 22.

Pump head 40 comprises a hub portion 42 (see FIG. 2) having a pair of diametrically opposed extensions 43,44 which are substantially identical in structure. Hub 42 has a circular recess 41 cut into its underside. When mounted on shaft 30, there is a slight clearance between the outer surface of wall 16 and the vertical wall defining recess 41. One of the aforementioned extensions, designated by numeral 43, is illustrated at the left-hand side of FIG. 3. It will be noted that extension 43 terminates in a pair of vertically spaced upper and lower plates 45 and 46, respectively, which define a space 47 therebetween.

Pump head 40 further comprises a pair of pivotally mounted swing arms 53, 54 which are substantially identical in structure. Each swing arm comprises a vertically extending side wall 55, an upper horizontally extending wall 56 and a lower, horizontally extending wall 57, all of which are illustrated in cross-section at the right-hand side of FIG. 3. Walls 56 and 57 are parallel to one another and define a space 59 therebetween for receiving roller means 63, 64. As seen in the drawings, roller means 63 is mounted in swing arm 53 and roller 64 is mounted in swing arm 54. Rollers 63 and 64 are mounted for rotation in one-way roller bearing and clutch assemblies 65 which will be described in more detail hereinafter. The two roller bearing and clutch assemblies 65 are in turn mounted between plates 56 and 57 of their respective swing arms 53 and 54 by vertically extending mounting pins 60.

Swing arms 53 and 54 are mounted at the outer ends of extensions 43 and 44 respectively. As illustrated at the left-hand side of FIG. 3, swing arm 53 is mounted to extension 43 by placing its upper and lower plates 56 and 57 over plates 45 and 46 at the end of extension 43 and employing a mounting pin 61 to hold the parts together. Low friction washers 62 are placed between the lower surface of plate 56 and upper surface of plate 45 and between the lower surface of plate 46 and the upper surface of plate 57. A small roller 70 is placed over mounting pin 61; this roller and pin are so sized that the roller may rotate freely about the pin. Swing arm 54 is mounted in the same manner to extension 44.

As explained above, each swing arm 53, 54 is pivotally mounted at one of its end to extensions 43, 44 by the use of a mounting pin 61. The second end of each swing arm is adjustably connected to the hub extension on which is mounted the other of the swing arms. Referring again to the right-hand side of FIG. 3, it will be seen that the second end of swing arm 54 is adjustably connected to extension 43 of hub portion 42. An adjustment screw 74 passes through a clearance hole 75 in swing arm 54 and threads into a threaded hole 76 in extension 43 of hub portion 42. Adjustment of screw 74 establishes the maximum outward limit of travel for swing arm 54 and its associated roller 64. A washer 77, preferably made of an elastomeric material, is placed under the head of adjustment screw 74 to absorb the shock as the swing arm 54 moves against its outer limit stop. A spring 78 is captured between swing arm 54 and a tensioning adjustment nut 79 and accompanying washer 80. Adjusting the position of nut 79 on the shaft of screw 74 serves to adjust the outward tension on the roller 64.

Guide elements 66, made of a material having a low coefficient of friction, are inserted into swing arms 53,54. These guides are located in front of rollers 63,64, that is, the guide elements precede the rollers in the direction of rotation. These guide elements serve to guide the segment of flexible tubing 85 (illustrated in its squeezed configuration in FIG. 3) into the central area of the rollers during operation of the pump.

As seen in FIGS. 1 and 2, pump 10 has a handle 23 comprising an arm 24 and a gripping means 26. This handle is pivotally mounted, as at 27, to the upper surface of the pump head 40, so it can be pivoted either into engagement with the opening 31 at the upper end of pump shaft 30 as seen in FIGS. 1 and 2, or the upright position shown in phantom in FIG. 2. The latter positioning of handle 23 is used when it is desired to turn the pump head manually.

As seen in FIG. 5, pump shaft 30 comprises an opening 31 extending inwardly from the upper end 30*a* of the shaft. In the preferred embodiment of the invention, opening 31, when viewed in the top plan view shown in FIG. 4, assumes the form of a rectangular slot which is defined by a base 32 and (when the slot is initially cut into the upper end of the shaft) a pair of generally parallel, vertically extending side walls 32*a*, 32*b*. After the slot is cut into the upper end of shaft 30, a pair of diametrically opposed ledges 37 and 38 are provided in shaft 30 by cutting a wedge shaped portion away from each of the aforementioned vertically extending side walls leave new wall portions 34 and 35 and to provide the shaft structure shown in FIG. 5.

The lower portion of the pump shaft is operatively connected to a drive means such as an electric motor. When the pump is to be operated by the motor, handle 23 is pivoted downwardly so its arm 24 engages opening 31 of the pump shaft. The pump head is thus mechanically coupled with the pump shaft so that rotation of the pump shaft by the motor serves to rotate the pump head. When the motor is started, pump shaft 30 begins to rotate in a counterclockwise direction. This counterclockwise rotation of the shaft is such that, as can be seen in FIG. 1 and FIG. 4, ledges 37 and 38 override recess 25 in arm 24 of handle 23, thus making it impossible for the pump head to lift off the pump shaft while the pump is being driven by the motor. In the event of a motor or power failure, the pump head can be manually rotated a short distance in the counterclockwise direction to remove ledges 37, 38 from their position overlying recess 25. Handle 23 is then lifted upwardly to the position shown in phantom in FIG. 2, thus disengaging the pump head from its operative connection to the pump shaft. The handle can then be used to manually rotate the pump head to provide the needed pumping action.

It is preferred, as indicated above, that the pump shaft comprise two ledges for overriding recess 25 in arm 24 of handle 23. It will be understood, however, that the pump head will be prevented from lifting off shaft 30 if the shaft comprises at least one ledge and if a wedge shaped portion has been cut out of the vertical wall diagonally opposite and across opening 31 from the one ledge. Referring to FIG. 7 at the lower left-hand side, it will be seen that, as described earlier, a wedge shaped portion of metal has been cut from original vertical side wall 32*a*, beginning a short distance underneath upper end 30*a* of the shaft, to leave a new underlying wall portion and thus provide the desired one ledge, this ledge being identical with ledge 37 in FIG. 5. At the diagonally opposite position on the shaft, that is, at the upper right-hand side of FIG. 7, a wedge shaped portion of original vertical wall 32*b* has been cut away, beginning at upper edge 30*a* of the shaft and continuing downwardly to its base 32. This leaves a new wall portion 35 but does not provide a second ledge corresponding to ledge 38 in FIG. 5.

As mentioned earlier, it is desirable that a peristaltic blood pump have means associated therewith to prevent rotation of the pump head in an "incorrect" or "undesired" direction during manual operation of the pump. In the present invention, such means are provided by mounting the pump roller or rollers in a combination roller bearing and overriding clutch assembly which allows rotation of the roller or rollers in one circumferential direction but not the another. A combination roller bearing and overriding clutch assembly suitable for use in the present invention is of the type described generally in U.S. Pat. No. 3,194,368, the teachings of which are hereby incorporated by reference. Such combination roller bearing and overriding clutch assemblies are commerically available from the Torrington Company in a variety of sizes. The Torrington DC roller bearing clutch is preferred for use in the present invention.

Referring to FIG. 1 of the drawings, it will be observed that the pump of the invention is arranged so that its pump head rotates in the direction indicated by arrow A, that is, the "correct" or "desired" directions of rotation of the pump head and the flow of blood through the flexible tubing segment (which is not illustrated in the drawings) is counterclockwise during operation. Where it is intended that pump head 40 rotate in the counterclockwise direction, roller 63, 64 should rotate in the opposite, or clockwise, direction during normal operation of the pump. Referring to the right-hand side of FIG. 3, roller 64 is friction mounted over the outer surface of an overriding roller bearing and clutch assembly 65 which, in turn, is mounted for unidirectional, clockwise rotation on mounting pin 60. When during manual operation of the pump, the pump head is turned in the desired counterclockwise direction, the bearing and clutch assembly allows roller 64 to rotate in the desired clockwise direction. If, however, the operator during manual operation of the pump inadvertently attempts to rotate the pump head in the "incorrect" or "undesired" clockwise direction, rollers 63, 64 would be prevented by the combination roller bearing and overriding clutch assembly from rotating in the counterclockwise direction. Since the clutch and bearing assembly prevents counterclockwise rotation of the rollers 63, 64, the rollers themselves drag against the outer surface of the flexible tubing segment in the pump, thus making it virtually impossible, to rotate the pump head in the "incorrect", clockwise direction. The operator immediately realizes that the rollers are dragging against the tubing and that he is attempting to rotate the pump head in the wrong direction. His attention having been drawn to the incorrect direction of rotation, it is a simple matter for the operator to then use the handle to operate the pump in the correct, that is, the counterclockwise direction.

I claim:

1. In a roller pump of the type comprising:

(a) a backing plate having an upper surface, a lower surface, and an opening therethrough, (b) a bearing mounted in said opening, (c) a shaft mounted in said bearing, said shaft having a first end portion and a second end portion, the first end portion of the shaft extending upwardly from the upper surface of the backing plate and having an opening which extends inwardly from the upper end of the shaft and which is defined by a pair of generally parallel, vertically extending side walls, the second end portion of the shaft extending downwardly from the lower surface of the backing plate and being adapted for coupling to a drive means, (d) an arcuate backing wall on the upper surface of the backing plate, (e) a pump head removably mounted on the upper portion of the shaft, said pump head comprising a hub portion and at least one roller means mounted for rotation about an axis which is parallel to the axis of said shaft, (f) a handle means comprising an arm being pivotally mounted on said pump head and adapted to be engaged with said opening in said shaft to mechanically couple said pump head to said shaft, the improvement wherein said arm has a generally centrally located recessed portion, said shaft comprises at least one ledge on one side of said opening, and a wedge shaped portion has been cut away from the side wall diagonally across said opening from said ledge, whereby when said arm is engaged with said opening and the pump shaft is rotated, said ledge overrides said recessed portion, thus preventing said pump head from moving upwardly on the shaft.

2. A pump according to claim 1 wherein said shaft comprises a pair of diametrically opposed ledges beneath each of which ledges a wedge-shaped portion of vertically extending side wall has been cut away.

3. In a roller pump of the type comprising:

(a) a backing plate having an upper surface, a lower surface, and an opening therethrough, (b) a bearing mounted in said opening, (c) a shaft mounted in said bearing, said shaft having an upper end, a first end portion adjacent said upper end, and a second end portion, the first end portion of the shaft extending upwardly from the upper surface of the backing plate and having an opening which extends inwardly from the upper end of the shaft and which is defined by a pair of generally parallel, vertically extending side walls, the second end portion of the shaft extending downwardly from the lower surface of the backing plate and being adapted for coupling to a drive means, (d) an arcuate backing wall on the upper surface of the backing plate, (e) a pump head removably mounted on the upper portion of the shaft, said pump head comprising a hub portion and at least one roller means mounted for rotation about an axis which is parallel to the axis of said shaft, (f) a handle means comprising an arm being pivotally mounted on said pump head and adapted to be engaged with said opening in said shaft to mechanically couple said pump head to said shaft, the improvement wherein said arm has a generally centrally located recessed portion and a pair of diametrically opposed ledges are provided in said shaft by cutting away from each of said side walls, beginning a short distance underneath said upper end, a wedge shaped portion whereby, when said arm is engaged with said opening and the pump shaft is rotated, said ledge overrides said recessed portion to prevent the pump head from moving upwardly on the shaft.

* * * * *